US007967521B2

(12) United States Patent
Schiavo

(10) Patent No.: US 7,967,521 B2
(45) Date of Patent: Jun. 28, 2011

(54) HINGED SOAP DISPENSING FOOT CLEANING DEVICE WITH INTERCHANGEABLE AND REPLACEABLE CARTRIDGES

(76) Inventor: Luis Schiavo, Maracay (VE)

( * ) Notice: Subject to any disclaimer, the term of this patent is extended or adjusted under 35 U.S.C. 154(b) by 239 days.

(21) Appl. No.: 12/487,480

(22) Filed: Jun. 18, 2009

(65) Prior Publication Data

US 2010/0322700 A1 Dec. 23, 2010

(51) Int. Cl.
*A46B 11/02* (2006.01)

(52) U.S. Cl. ..... 401/188 R; 401/157; 401/183; 4/622

(58) Field of Classification Search ..... 401/144, 401/145, 152, 157, 158, 163, 183, 184, 188 R, 401/195; 4/622
See application file for complete search history.

(56) References Cited

U.S. PATENT DOCUMENTS

| | | | | |
|---|---|---|---|---|
| 3,548,439 | A | 12/1970 | Berst | |
| 3,973,286 | A | 8/1976 | Logan | |
| 5,163,200 | A * | 11/1992 | Carlin et al. | 401/183 |
| 5,983,433 | A | 11/1999 | Chapman | |
| 6,662,398 | B1 | 12/2003 | Thomson | |

* cited by examiner

*Primary Examiner* — Tuan N Nguyen
(74) *Attorney, Agent, or Firm* — Craig S. Kirsch; Ruben Alcoba

(57) ABSTRACT

A hinged soap dispensing foot cleaning device with interchangeable and replaceable cartridges comprising inter alia, a hinged fool cleaning chassis assembly, a plurality of interchangeable and replaceable bristle cartridges sized and configured to be removably attached to the chassis assembly, a pump means for pumping a liquid sized and configured to be removably and operatively connected to the chassis assembly, and a liquid filled bladder sized and configured to be housed in the chassis assembly and operatively connected to the pump means and chassis assembly.

7 Claims, 5 Drawing Sheets

Figure 1:
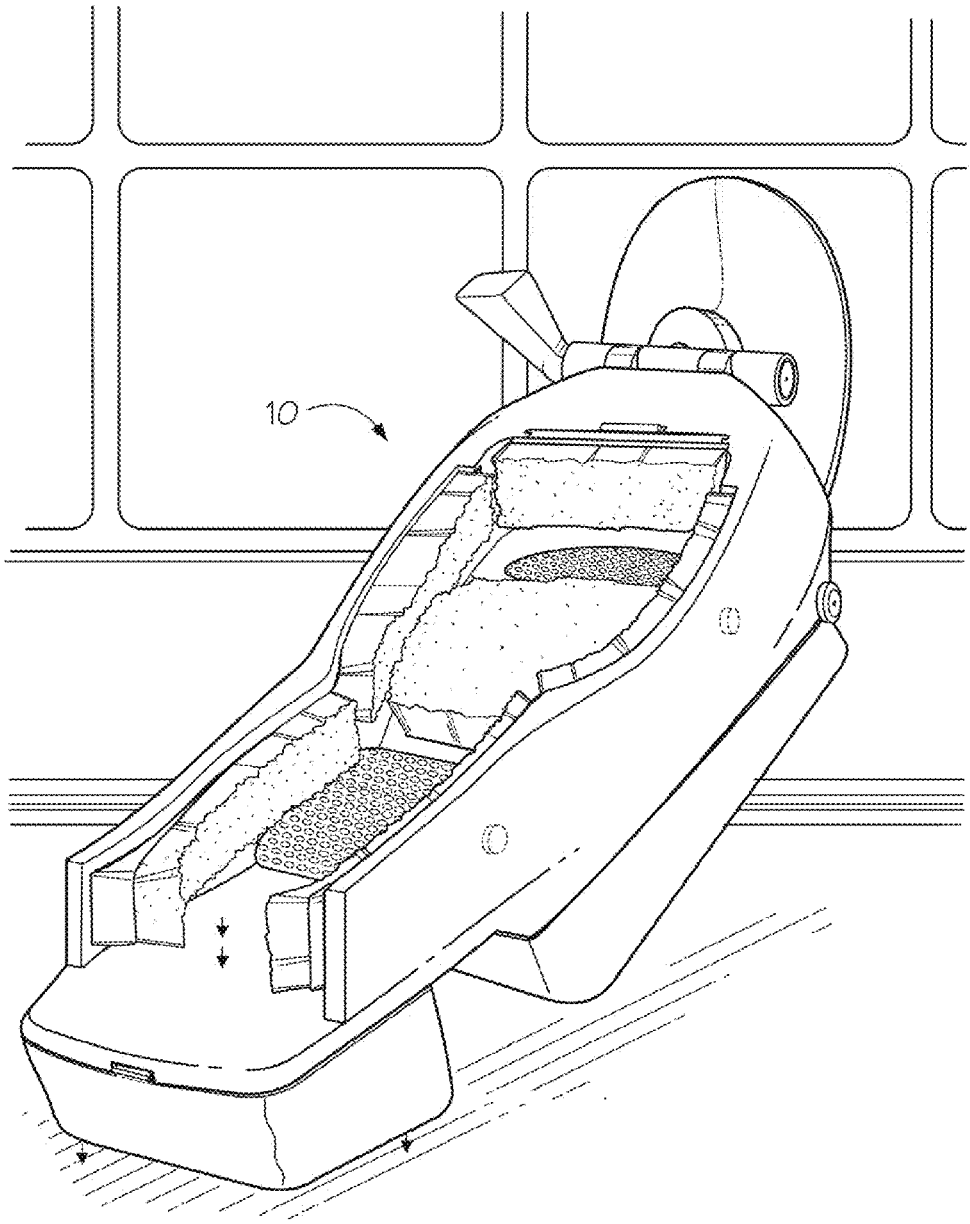

HINGED SOAP DISPENSING FOOT CLEANING DEVICE WITH INTERCHANGEABLE AND REPLACEABLE CARTRIDGES

BACKGROUND

The present invention relates to a foot cleaning device and more specifically to a hinged soap dispensing foot cleaning device with interchangeable and replaceable cartridges of bristles having varying sizes and bristle thickness.

While bathing one day the inventor realized the difficulties inherent in washing one's own feet.

The anatomical location of the foot, i.e. at the extremity of each leg, coupled with the necessity of using each foot to balance in an upright position, makes the foot an extremely difficult body part to properly clean. Nonetheless, properly cleaning one's feet is extremely important and failure to do so can result in a variety of heath and hygiene issues.

Most people bathe themselves while standing in an upright position. Cleaning one's feet while in the upright position typically requires an awkward balancing act where the bather balances on one foot while soaping the other foot. As such, the typical foot bathing experience is not only a difficult one, but potentially dangerous as well. The level of danger increases with the age and the increasing lack of mobility and flexibility of the bather.

Cluttering the already limited floor space of a typical small bathtub or shower can create additional dangers to the bather, especially when the bather's eyes are closed while washing his or her hair. As such, the inventor realized that in addition to creating a device that would facilitate the washing of one's feet while standing, the inventor realized that the device also had to be easily storable and removable from the limited floor space of the bathtub or shower.

The feet are a particularly sensitive area of the body for many people. Furthermore, the level of foot sensitivity varies among different people and therefore a sensation that one person might find to be extremely enjoyable might be intolerable for another person. As such, the inventor realized that the length and bristle thickness for the foot scrubbing device had to vary to accommodate the preferences of a diverse level of foot sensitivity.

Additionally, as the foot is a body part that is susceptible to fungal or bacterial infections, it would be desirable to have interchangeable and replaceable bristle cartridges on the device so that one device could be used by several people without the risk of cross contamination by an infected user.

The inventor also realized that in addition to taking up floor space in the bathtub or shower, a foot scrubbing device that remains in contact with the floor, creates the opportunity for stagnant water to accumulate, which then increases the likelihood of molds, mildews and other undesirable fungi growing on the device. As such, it became evident that the device must be able to dry in an upright position so that water would not accumulate on the device.

The present invention was invented to address the foregoing problems. Specifically, a hinged soap dispensing foot cleaning device with interchangeable and replaceable cartridges comprising inter alia, a hinged foot cleaning chassis assembly, a plurality of interchangeable and replaceable bristle cartridges sized and configured to be removably attached to the chassis assembly, a pump means for pumping a liquid, sized and configured to be removably and operatively connected to the chassis assembly, and a liquid filled bladder sized and configured to be housed in the chassis assembly.

In operation, a user places one foot on the foot cleaning chassis and applies a predetermined amount of pressure on the pump means with the user's heel, thereby dispensing a predetermined amount of liquid soap or other liquid from the liquid filled bladder. The liquid travels about the tubular members of the foot cleaning chassis until it is dispensed about the bristle cartridges. The user then can move his or her foot back and forth about the bristles of the bristle cartridge thereby creating a lather and cleaning the user's feet.

When the user's feet are satisfactorily cleaned, the user can rinse the device using a shower head or other water supply, then raise the device to an upright position using the hinge attached to foot cleaning chassis to dry and store the device. In the event the bristles on the bristle cartridges become worn or uncomfortable to the user, the user can simply replace the bristle cartridges.

The hinged storage feature along with the interchangeable and replaceable bristle cartridges creates a foot cleaning device that addresses problems that have yet to be adequately addressed in this field of technology.

An objective of the present invention is to provide a device that facilitates the cleaning of one's own feet while standing in the upright position.

Another objective of the present invention is to provide a foot cleaning device that has interchangeable and replaceable bristle cartridges.

Another objective of the present invention is to provide a foot cleaning device that is adapted to a varying level of foot sensitivity.

Another objective of the present invention is to provide a foot cleaning device that can be used by multiple users with a limited risk of cross contamination by one of the users.

Another objective of the present invention is to provide a foot cleaning device that can easily be stored when not in use.

Yet, another objective of the present invention is to provide a foot cleaning device that will dry in an upright position thereby reducing the amount of standing water on the device.

Information relevant to attempts to address these objectives can be found in U.S. Pat. No. 6,662,398; U.S. Pat. No. 3,973,286; and U.S. Pat. No. 3,548,439; however each one of these references suffers from one or more of the following disadvantages: the references do not provide for a method for storage when not in use; the references do not provide for a hinged arm that allows for upright drying, the references do not provide for way to reduce the accumulation of standing water in or on the device, and the references do not provide for interchangeable and replaceable bristle cartridges with bristles of varying size and thickness.

For the foregoing reasons there is a need for a hinged soap dispensing foot scrubbing device with interchangeable and replaceable cartridges comprising inter alia, a hinged foot cleaning chassis assembly, a plurality of interchangeable and replaceable bristle cartridges sized and configured to be removably attached to the chassis assembly, a pump means for pumping a liquid, sized and configured to be removably and operatively connected to the chassis assembly, and a liquid filled bladder sized and configured to be housed in the chassis assembly.

SUMMARY

A hinged soap dispensing foot cleaning device with interchangeable and replaceable cartridges comprising inter alia, a hinged foot cleaning chassis assembly, a plurality of interchangeable and replaceable bristle cartridges sized and configured to be removably attached to the chassis assembly, a pump means for pumping a liquid sized and configured to be removably and operatively connected to the chassis assembly, and a liquid filled bladder sized and configured to be housed in the chassis assembly.

In operation, a user places one foot on the foot cleaning chassis and applies a predetermined amount of pressure on the pump means with the user's heel, thereby dispensing a predetermined amount of liquid soap or other liquid from the liquid filled bladder. The liquid travels about the tubular members of the foot cleaning chassis until it is dispensed about the bristle cartridges. The user then can move his or her foot back and forth about the bristles of the bristle cartridge thereby creating a lather and cleaning the user's feet. When the user's feet are satisfactorily cleaned, the user can rinse the device using a shower head or other water supply, then raise the device to an upright position using the hinge attached to foot cleaning chassis to dry and store the device. In the event the bristles on the bristle cartridges become worn or uncomfortable to the user, the user can simply replace the bristle cartridges.

The hinged storage feature along with interchangeable and replaceable bristle cartridges create a foot cleaning device that addresses problems that have yet to be adequately addressed in this field of technology including, inter alia, reducing the likelihood of mildew or other fungi from forming on the device, reducing the likelihood of cross contamination by multiple users and addressing the various foot sensitivity levels of a diverse user population.

DRAWINGS

Figure 2:
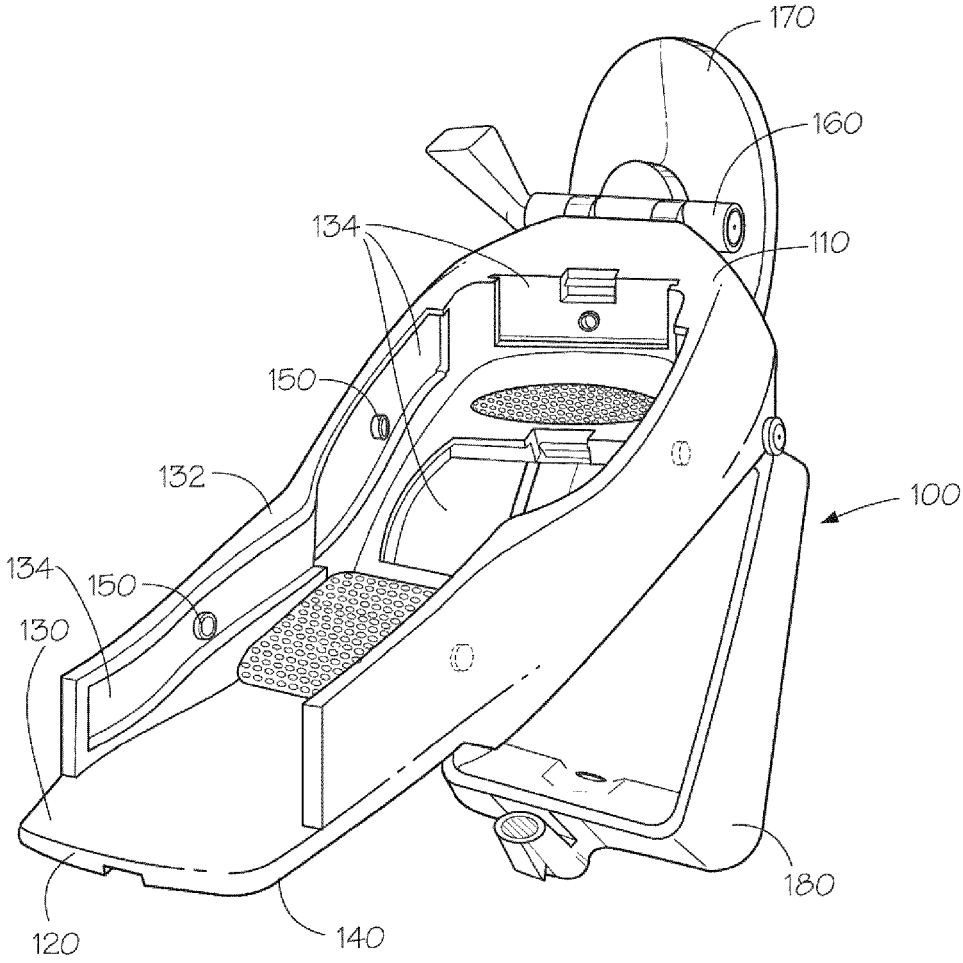
Figure 3:
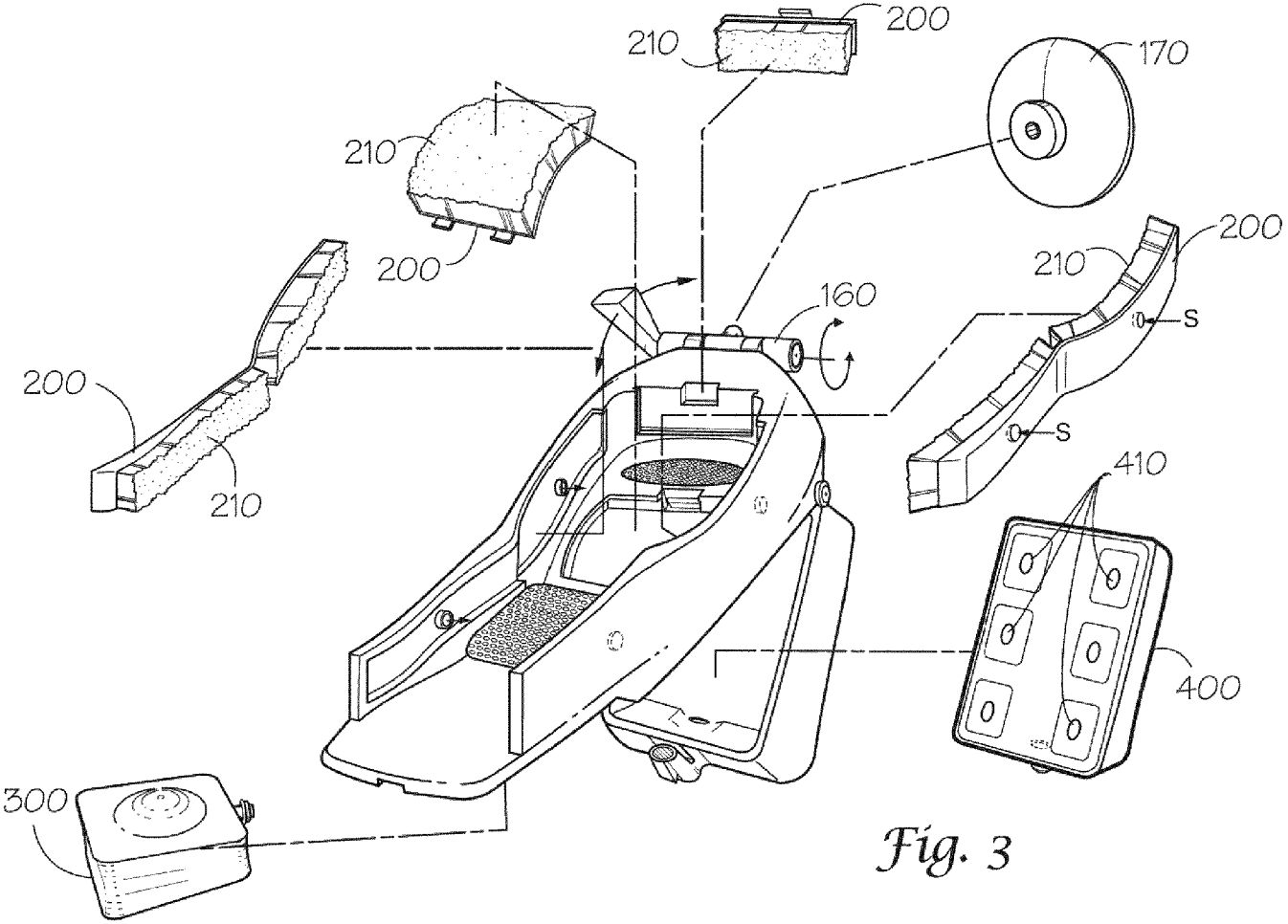
Figures 4, 4A:
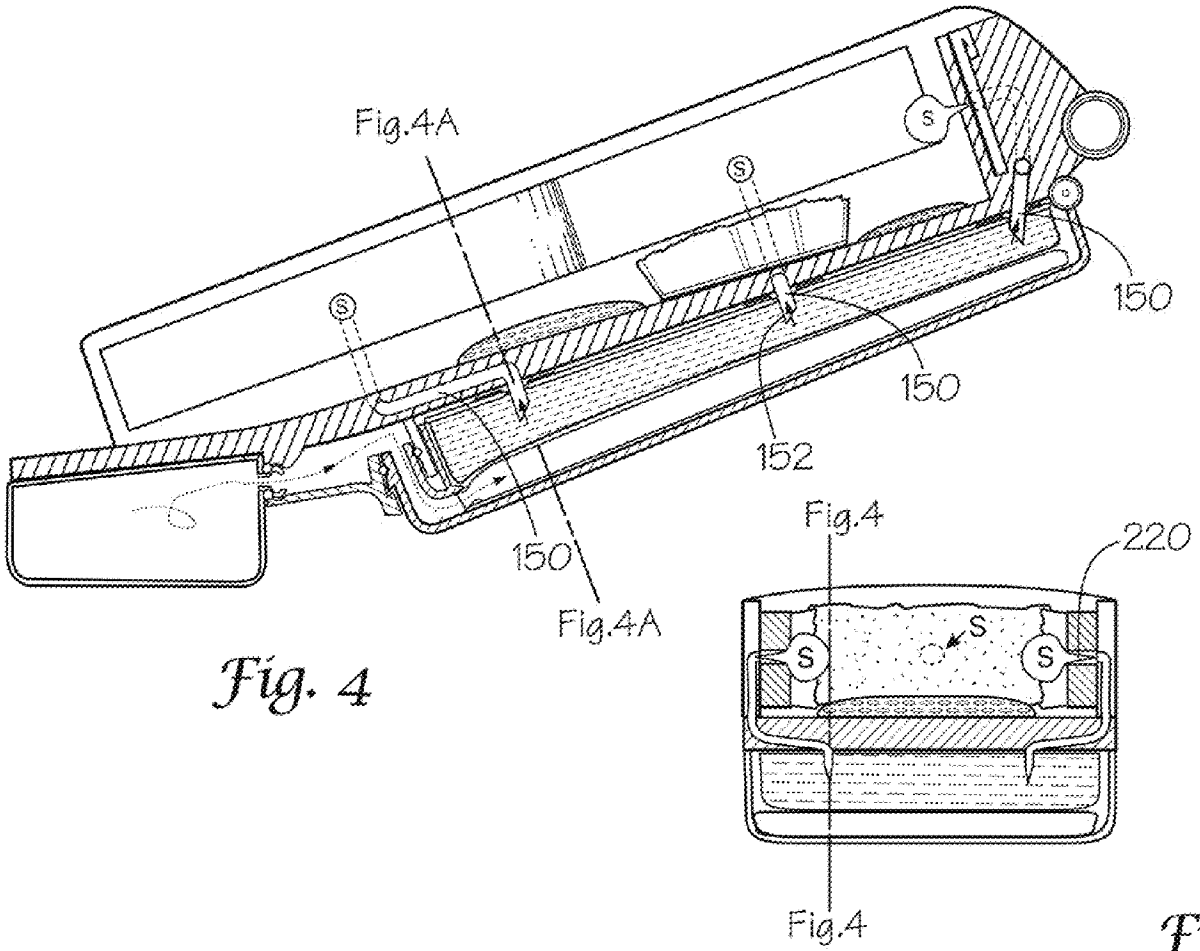
Figure 5:
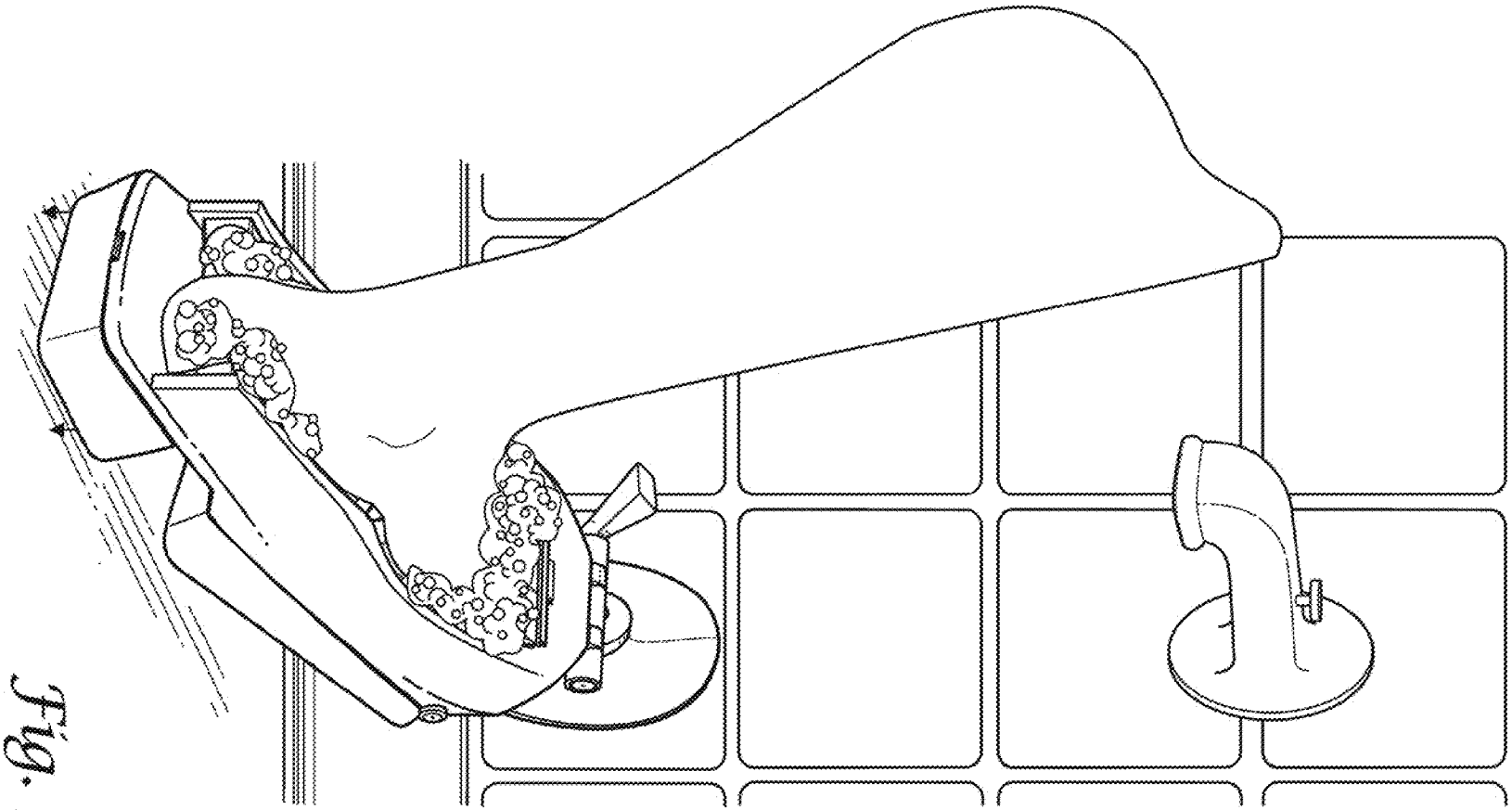

These and other features, aspects, and advantages of the present invention will become better understood with regard to the following description, appended claims and drawings where:

FIG. 1. shows a perspective view of one embodiment of the device;

FIG. 2. shows a perspective view of one embodiment of the chassis assembly of the device;

FIG. 3. shows an exploded perspective view of one embodiment of the device;

FIG. 4. shows a cross-sectional side plan view of one embodiment of the device;

FIG. 4A. shows a cross-sectional back plan view of one embodiment of the device; and FIG. 5. shows a depiction of one embodiment of the device in use.

DESCRIPTION

As shown in FIGS. 1-5 a hinged soap dispensing foot scrubbing device with interchangeable and replaceable cartridges 10 comprising inter alia, a hinged foot cleaning chassis assembly 100, a plurality of interchangeable and replaceable bristle cartridges 200 sized and configured to be removably attached to the chassis assembly 100, a pump means 300 for pumping a liquid sized and configured to be removably and operatively connected to the chassis assembly 100, and a liquid filled bladder 400 sized and configured to be removably housed in the chassis assembly 100.

In one embodiment, the hinged foot cleaning chassis assembly 100 might define a front end 110, a back end 120, an upper surface 130, and a lower surface 140, wherein the upper surface 130 includes a raised lip 132. It is envisioned that the upper surface 130 and particularly the raised lip 132 might include a plurality of receiving ports 134. The chassis assembly 100 might further comprise of a plurality of tubular members 150 sized and configured to facilitate fluid communication between the cartridges 200 and the bladder 400. It is envisioned that at least one tubular member 150 might further comprise of a pointed end 152 for puncturing the bladder 400 at a predetermined location.

The chassis assembly 100 might further comprise of a hinge means 160 for pivoting the device 10 about an axis. It is envisioned that the hinge means 160 might be operatively connected to the front end 110 of the chassis assembly 100. In certain embodiments of the device 10, the hinge means 160 might further comprise of a mechanical assistance system such as a spring, a lever, a gear system or other systems for raising or lowering that are known in the art. It is envisioned that the hinge 160 might be fixedly attached to a suction cup 170 that is sized and configured to secure the device 10 to a flat surface with sufficient suction to support the weight of the device 10.

The chassis assembly 100 might further comprise of a hinged compartment 180 operatively connected to the lower surface 140 of the chassis body 100. It is envisioned that the hinged compartment 180 will pivot from an open position as shown in FIGS. 2, 3, and 6 to a closed position as shown in FIG. 1. In one embodiment the hinged compartment 180 is secured in the closed position by interlocking snapping portions of the chassis assembly 100.

It is envisioned that the chassis assembly 100 might be composed of a waterproof semi rigid polymer such as plastic or rubber or a similar compound known in the art. In a preferred embodiment, the chassis assembly 100 would be manufactured using injection molding technology.

The bristle cartridges 200 comprise of a plurality of bristle members 210 of varying sizes and thicknesses sized and configured to be removably attached to the upper surface 130 of the chassis assembly 100. It is envisioned that the cartridges 200 might be interchangeable and replaceable so that the user might replace the cartridges 200 if one was to become worn or uncomfortable. In a preferred embodiment, the bristle members 210 would be of varying lengths depending on the contours of the foot that the bristle member 210 was contacting, for example the bristle members 210 might be shorter for contacting the lower and side portions of the user's foot and longer for contacting the top portion of the user's foot. It is envisioned that the thickness and material of the bristle members 210 will vary to accommodate the various levels of foot sensitivity of the user. In a preferred embodiment, the bristle cartridges 200 and the bristle members 210 might be composed of a polymer such as rubber or plastic similar to that which is used for toothbrush bristles.

It is envisioned that bristle cartridges 200 might be sized and configured to be removably attached to the receiving ports 134 of the upper surface 130 and to the raised lip 132. In a preferred embodiment, the cartridges 200 might be removably attached to the receiving ports 134 using a tongue and groove or a snapping system. It is envisioned that the cartridges 200 might further comprise of fluid dispensing ports 220 sized and configured to align with the tubular members 150 of the chassis assembly 100. By having the cartridges 200 interchangeable and replaceable, the device 10 can be used by multiple users each having their own cartridges 200, as such the device 10 can be used by multiple users with a limited risk of cross contamination by one of the users.

The pump 300 means for pumping a liquid might be calibrated with a specific threshold activation pressure to ensure that liquid is not pumped inadvertently and sized and configured to be removably and operatively connected to the lower surface 130 of the chassis assembly 100. It is envisioned that the pump 300 means might be configured to be in fluid communication with the liquid filled bladder 400 and the tubular members 150 of the chassis assembly 100 so that when the requisite activation pressure is applied to the pump 300 means, liquid is dispensed through the fluid dispensing ports 220 of the cartridges 200. In a preferred embodiment the pump 300 might be removably attached to the lower surface 130 of the chassis assembly 100 using a tongue and groove or snapping system.

It is envisioned that the liquid filled bladder 400 might be substantially rectangular in shape and sized and configured to be housed in the hinged compartment 180 of the chassis assembly 100 and operatively connected to the pump 300 means and chassis assembly 100. In a preferred embodiment, the bladder 400 might have a plurality of perforated dispensing ports 410 sized and configured to align with the tubular members 150 so that the pointed ends 152 puncture the bladder 400 at the perforated dispensing ports 410 when the hinged compartment 180 is in the closed position. It is envisioned that the bladder 400 might be filled with a soap product and might be replaced when its contents are emptied. It is further envisioned that the bladder 400 might be filled with other liquid products such as anti-bacterial, anti-fungal, or skin softening products.

In operation, as shown in FIGS. 8 and 9, the user places one foot through the back end 120 of the chassis assembly 100 and applies a predetermined amount of pressure to the pump 300 means with the user's heel. The pump 300 means, being in fluid communication with the bladder 400, dispenses a predetermined amount of liquid soap or other liquid from the liquid filled bladder 400. The liquid travels about the tubular members 150 of the foot cleaning chassis assembly 100 until it is dispensed about the bristle cartridges 200. The user then can move his or her foot back and forth about the bristles of the bristle cartridge thereby creating a lather and cleaning the user's foot. When the user's feet are satisfactorily cleaned, the user can rinse the device 10 using a shower head or other water supply, then raise the device 10 to an upright position using the hinge 160 attached to foot cleaning chassis assembly 100 to dry and store the device 10. In the event the bristle members 210 on the bristle cartridges 200 become worn or uncomfortable to the user, the user can simply replace the bristle cartridges 200. In the event the bladder 400 is emptied or the user wishes to change the liquid being dispensed, the user simply pivots the hinged compartment 180 to the open position, removes the bladder 400, and then pivots the hinged compartment 180 to the closed position. By closing the hinged compartment 180, the pointed ends 152 of the tubular members 150 puncture the bladder 400 at the perforated dispensing ports 410 thereby creating a fluid dispensing circuit from which fluid can be dispensed as described above.

An advantage of the present invention is that it provides a device that facilitates the cleaning of one's own feet while standing in the upright position.

Another advantage of the present invention is that it provides a foot cleaning device that has interchangeable and replaceable bristle cartridges.

Another advantage of the present invention is that it provides a foot cleaning device that is adapted to a varying level of foot sensitivity.

Another advantage of the present invention is that it provides a foot cleaning device that can be used by multiple users with a limited risk of cross contamination by one of the users.

Yet, another advantage of the present invention is that it provides a foot cleaning device that can easily be stored when not in use.

Still, a further advantage of the present invention is that it provides a foot cleaning device that will dry in an upright position reducing the amount of standing water on the device.

Although the present invention has been described in considerable detail with reference to certain preferred versions thereof, other versions are possible. Therefore, the spirit and the scope of the claims should not be limited to the description of the preferred versions contained herein.

The invention claimed is:

1. A hinged soap dispensing foot cleaning device with interchangeable and replaceable cartridges comprising:

a hinged foot cleaning chassis assembly comprising of a chassis body defining a front end, a back end, an upper surface, and a lower surface, wherein the upper surface includes a raised lip; a hinge operatively connected to the front end of the chassis assembly; a suction cup fixedly attached to the hinge; and a hinged compartment operatively connected to the lower surface of the chassis body;

a plurality of bristle cartridges sized and configured to be removably attached to the upper surface of the chassis assembly;

a pump means for pumping a liquid, sized and configured to be removably and operatively connected to the lower surface of the chassis assembly; and a liquid filled bladder sized and configured to be housed in the hinged compartment of the chassis assembly and operatively connected to the pump means and chassis assembly.

2. The device of claim 1, wherein the chassis further comprises of a plurality of tubular members sized and configured to facilitate fluid communication between the cartridges and the bladder.

3. The device of claim 2, wherein at least one tubular member further comprises of a pointed end for puncturing the bladder at a predetermined location.

4. The device of claim 3, wherein the cartridges are interchangeable and replaceable.

5. The device of claim 4, wherein the cartridges comprise of a plurality of bristle members of varying sizes and thicknesses.

6. The device of claim 5, wherein the pump means is calibrated with a specific threshold activation pressure to ensure that liquid is not pumped inadvertently.

7. The device of claim 6, wherein the bladder is filled with a soap product.

* * * * *